US011187194B2

(12) United States Patent
Murata et al.

(10) Patent No.: US 11,187,194 B2
(45) Date of Patent: Nov. 30, 2021

(54) FUEL VAPOR PROCESSING APPARATUS

(71) Applicant: AISAN KOGYO KABUSHIKI KAISHA, Obu (JP)

(72) Inventors: Kazuho Murata, Nagoya (JP); Toshihiko Yamauchi, Kasugai (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 214 days.

(21) Appl. No.: 16/459,878

(22) Filed: Jul. 2, 2019

(65) Prior Publication Data

US 2020/0011276 A1 Jan. 9, 2020

(30) Foreign Application Priority Data

Jul. 5, 2018 (JP) ..... JP2018-128218

(51) Int. Cl.
*F02M 25/08* (2006.01)

(52) U.S. Cl.
CPC ..... *F02M 25/0854* (2013.01)

(58) Field of Classification Search
CPC ..... F02M 25/0854; B01D 53/04–0454
See application file for complete search history.

(56) References Cited

U.S. PATENT DOCUMENTS 4,750,923 A * 6/1988 Haruta ..... B01D 53/0415 55/319
5,207,808 A * 5/1993 Haruta ..... B01D 53/0407 123/519
5,269,837 A 12/1993 Ohashi et al.
7,294,179 B2 11/2007 Kim et al.
9,556,830 B2 1/2017 Makino et al.
(Continued)

FOREIGN PATENT DOCUMENTS

CN 105422322 A 3/2016
CN 206111378 U 4/2017
GB 2550173 A 11/2017
(Continued)

OTHER PUBLICATIONS

Chinese Office Action dated Jan. 22, 2021, for Chinese Application No. 201910602944.9 (5 p.).
(Continued)

*Primary Examiner* — Sizo B Vilakazi
*Assistant Examiner* — Mark L. Greene
(74) *Attorney, Agent, or Firm* — Conley Rose, P.C.

(57) ABSTRACT

A fuel vapor processing apparatus includes a casing, an adsorbent, and a mixer. The casing includes an atmospheric port and a purge port. In addition, the casing forms an atmospheric port-side adsorption chamber, an agitation chamber, and a purge port-side adsorption chamber therein. The atmospheric port-side adsorption chamber, the agitation chamber, and the purge port-side adsorption chamber are continuously arranged in a gas flow direction from the atmospheric port through the casing to the purge port. The adsorbent fills the atmospheric port-side adsorption chamber and the purge port-side adsorption chamber. The adsorbent is configured to adsorb and desorb fuel vapor. The mixer is disposed in the agitation chamber and includes a spiral flow forming part configured to spirally guide gas flowing through the agitation chamber.

4 Claims, 8 Drawing Sheets

(56) References Cited

U.S. PATENT DOCUMENTS

2021/0199071 A1* 7/2021 Ajiki ..... B01D 53/0446

FOREIGN PATENT DOCUMENTS

| | | | |
|---|---|---|---|
| JP | S6284662 | U | 5/1987 |
| JP | H05187331 | A | 7/1993 |
| JP | H05195884 | A | 8/1993 |
| JP | H08128364 | A | 5/1996 |
| JP | 2005195007 | A | 7/2005 |
| JP | 2011503690 | | 9/2011 |

OTHER PUBLICATIONS

English Translation of Chinese Office Action dated Jan. 22, 2021, for Chinese Application No. 201910602944.9 (6 p.).
Japanese Office Action dated Aug. 2, 2021, for Japanese Application No. 2018-128218 (4 p.).
English Translation of Japanese Office Action dated Aug. 2, 2021, for Japanese Application No. 2018-128218 (4 p.).

* cited by examiner

FUEL VAPOR PROCESSING APPARATUS

CROSS-REFERENCE TO RELATED APPLICATIONS

This application claims priority to Japanese patent application serial number 2018-128218, filed Jul. 5, 2018 which is hereby incorporated herein by reference in its entirety for all purposes.

STATEMENT REGARDING FEDERALLY SPONSORED RESEARCH OR DEVELOPMENT

Not applicable.

BACKGROUND

This disclosure relates generally to fuel vapor processing apparatuses.

A vehicle, such as an automobile, is equipped with a fuel vapor processing apparatus. The fuel vapor processing apparatus has an adsorption chamber filled with an adsorbent capable of adsorbing and desorbing fuel vapor so as to prevent leakage of the fuel vapor from a fuel tank into the atmosphere. Such fuel vapor processing apparatus is also referred to as a canister. During parking or the like, when the fuel vapor generates in the fuel tank and flows into the adsorption chamber of the fuel vapor processing apparatus, the adsorbent in the adsorption chamber adsorbs the fuel vapor. Then, when an internal combustion engine of the vehicle is started, an intake negative pressure of the engine acts on the adsorption chamber so as to introduce purge air from outside of the fuel vapor processing apparatus into the adsorption chamber. The fuel vapor is purged from the adsorbent filled in the adsorption chamber and is burned in the engine.

The purge air tends to flow through a central portion of the adsorption chamber and does not tend to flow through an outer peripheral portion thereof. Thus, the fuel vapor is not uniformly purged from the adsorbent such that the fuel vapor tends to remain in the outer peripheral portion of the adsorption chamber.

In contrast, the amount of the purge air flowing through the central portion of the adsorption chamber is large, and thus, the desorption of the fuel vapor in the central portion is large. As a result, the temperature of the adsorbent in the central portion and the temperature of the purge air flowing through the central portion are lower than those of the outer peripheral portion due to vaporization heat generated by desorption of the fuel vapor from the adsorbent. In general, the adsorption capacity of the adsorbent varies with the temperature thereof. More specifically, the lower the temperature of the adsorbent, the larger the adsorption capacity. Thus, a relatively small amount of the fuel vapor is desorbed from the adsorbent in the low temperature condition. Accordingly, the quantity of fuel vapor desorption by a fixed amount of the purge air, i.e., the desorption efficiency, is relatively low in the central portion.

Similarly, when the fuel vapor-containing gas is introduced into the adsorption chamber, it tends to flow predominantly through the central portion of the adsorption chamber. Thus, the temperature of the adsorbent in the central portion and the temperature of the fuel vapor-containing gas flowing through the central portion are typically higher than those of the outer peripheral portion due to condensing heat generated by adsorption of the fuel vapor on the adsorbent. In general, the adsorption capacity of the adsorbent varies with the temperature thereof. More specifically, the higher the temperature of the adsorbent, the lower the adsorption capacity thereof. Thus, very little of the fuel vapor is adsorbed on the adsorbent in the high temperature condition. Accordingly, the quantity of fuel vapor adsorbed by a fixed amount of the fuel vapor, i.e., the adsorption efficiency, is relatively low in the central portion.

Japanese Laid-Open Patent Publication No. 2005-195007 discloses one type of fuel vapor processing apparatus. The fuel vapor processing apparatus includes a casing and a mixer. The casing forms an atmospheric port-side adsorption chamber, an agitation chamber, and a purge port-side adsorption chamber therein such that they are arranged continuously and linearly along the gas flow direction from the atmospheric port toward the purge port. The mixer is disposed in the agitation chamber. When the purge air flows into the agitation chamber from the atmospheric port-side adsorption chamber, the mixer guides the purge air nonlinearly toward the purge port-side adsorption chamber. Thus, the purge air can be homogenized in the agitation chamber, and difference in the flow amount of the purge air between the central portion and the outer peripheral portion in the purge port-side adsorption chamber can be decreased. Accordingly, the desorption efficiency in the purge port-side adsorption chamber can be increased.

Similarly, when the fuel vapor-containing gas flows into the agitation chamber from the purge port-side adsorption chamber, the mixer guides the fuel vapor-containing gas nonlinearly toward the atmospheric port-side adsorption chamber. Due to this configuration, the fuel vapor can be homogenized in the agitation chamber, and difference in the flow amount of the fuel vapor-containing gas between the central portion and the outer peripheral portion in the atmospheric port-side adsorption chamber can be decreased. Accordingly, adsorption efficiency in the atmospheric port-side adsorption chamber can be increased.

BRIEF SUMMARY

In one aspect of this disclosure, a fuel vapor processing apparatus includes a casing, an adsorbent, and a mixer. The casing includes an atmospheric port and a purge port. The casing forms an atmospheric port-side adsorption chamber, an agitation chamber, and a purge port-side adsorption chamber therein. The atmospheric port-side adsorption chamber, the agitation chamber, and the purge port-side adsorption chamber are continuously arranged in a gas flow direction from the atmospheric port through the inside of the casing to the purge port. The adsorbent fills the atmospheric port-side adsorption chamber and the purge port-side adsorption chamber. The adsorbent is configured to adsorb and desorb fuel vapor. The mixer is disposed in the agitation chamber and includes a spiral flow forming part. The spiral flow forming part is configured to spirally guide gas flowing through the agitation chamber.

According to this aspect, while the gas flows through the agitation chamber, the gas is spirally guided and stirred by the spiral flow forming part of the mixer in the agitation chamber. Thus, during the purge operation, the purge air is easily mixed in the agitation chamber so as to efficiently homogenize the purge air. The desorption efficiency of the fuel vapor in the purge port-side adsorption chamber by introducing the homogenized purge air into the purge port-side adsorption chamber. Similarly, during the adsorption operation, the fuel vapor-containing gas is easily mixed in the agitation chamber so as to efficiently homogenize the fuel vapor-containing gas. The adsorption efficiency of the fuel vapor in the atmospheric port-side adsorption chamber is increased by introducing the homogenized fuel vapor-containing gas into the atmospheric port-side adsorption chamber.

Other objects, features and advantage of the present teaching will be readily understood after reading the following detailed description together with the accompanying drawings and the claims.

BRIEF DESCRIPTION OF THE DRAWINGS

For a detailed description of the preferred embodiments of the present teaching, reference will now be made to the accompanying drawings.

DETAILED DESCRIPTION

Figure 1:
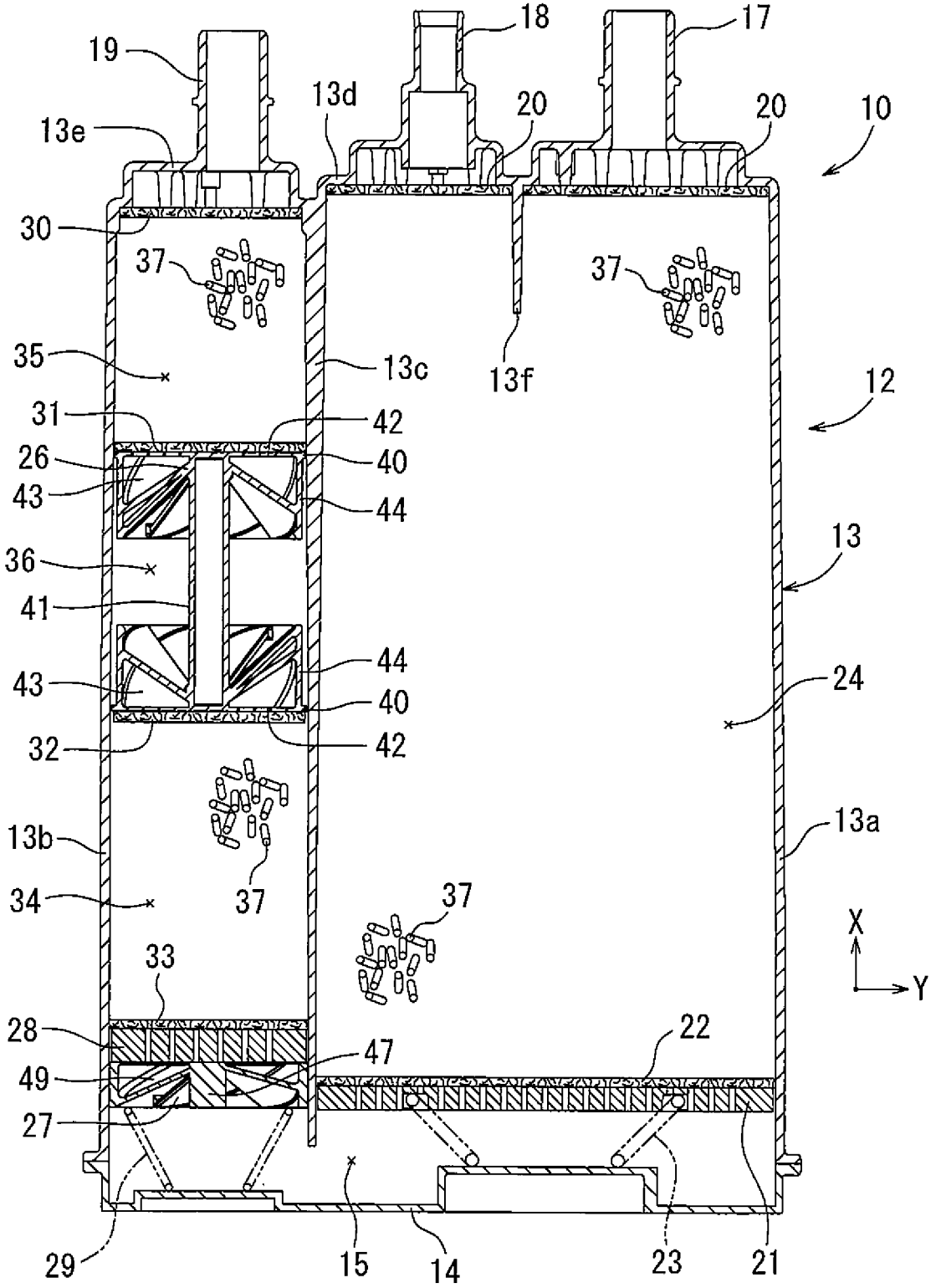
FIG. 1 is a cross-sectional view of an embodiment of a fuel vapor processing apparatus including a first mixer and a second mixer in accordance with principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different people may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections.

Each of the additional features and teachings disclosed above and below may be utilized separately or in conjunction with other features and teachings to provide improved fuel vapor processing apparatuses. Representative examples of the present teachings, which examples utilized many of these additional features and teachings both separately and in conjunction with one another, will now be described in detail with reference to the attached drawings. This detailed description is merely intended to teach a person skilled in the art further details for practicing preferred aspects of the present teachings and is not intended to limit the scope of the claimed subject-matter. Only the claims define the scope of the claimed subject-matter. Therefore, combinations of features and steps disclosed in the following detailed description may not be necessary to practice the claimed subject-matter in the broadest sense, and are instead taught merely to particularly describe representative examples of the present teachings. Moreover, various features of the representative examples and the dependent claims may be combined in ways that are not specifically enumerated in order to provide additional useful embodiments of the present teachings.

As previously described, Japanese Laid-Open Patent Publication No. 2005-195007 teaches a mixer in the agitation chamber so as to increase the desorption efficiency in the purge port-side adsorption chamber and increase the adsorption efficiency in the atmospheric port-side adsorption chamber. However, in Japanese Laid-Open Patent Publication No. 2005-195007, the mixer is a plate having a plurality of holes. Thus, it is difficult to sufficiently homogenize the purge air in the agitation chamber while the purge air flows through the agitation chamber. Similarly, it is difficult to sufficiently homogenize the fuel vapor-containing gas in the agitation chamber while the fuel vapor-containing gas flows through the agitation chamber. Therefore, there has been a need for improved fuel vapor processing apparatuses.

The present teaching will be described with reference to accompanying drawings. In each drawing, the direction X is the upper direction, and the direction Y is the rightward direction. However, these directions do not limit the installation orientation of a fuel vapor processing apparatus.

A first embodiment will be described. In the first embodiment, a fuel vapor processing apparatus 10 is a canister mounted on a vehicle such as an automobile.

As shown in FIG. 1, the fuel vapor processing apparatus 10 includes a casing 12. In this embodiment, the casing 12 has a substantial rectangular parallelepiped shape and is made from a resin material. The casing 12 includes a hollow casing body 13. The casing body 13 includes a square tube part 13*a*, a cylindrical part 13*b*, a partition wall 13*c* between parts 13*a*, 13*b*, a first upper wall 13*d*, and a second upper wall 13*e*. The square tube part 13*a* has a square cross-section in a plane oriented perpendicular to the vertical direction. The cylindrical part 13*b* has a circular cross-section in a plane oriented perpendicular to the vertical direction and is laterally adjacent to the square tube part 13*a* (on the left of the square tube part 13*a* in FIG. 1). The square tube part 13*a* and the cylindrical part 13*b* extend in the vertical direction parallel to each other. The partition wall 13*c* extends in the vertical direction and couples the square tube part 13*a* with the cylindrical part 13*b*. The first upper wall 13*d* closes an upper end of the square tube part 13*a*, and the second upper wall 13*e* closes an upper end of the cylindrical part 13*b*. A lower end of the casing body 13 is closed by a lid member 14.

As shown in FIG. 1, the partition wall 13*c* divides an internal space of the casing body 13 into an internal space of the square tube part 13*a* and an internal space of the cylindrical part 13*b*. These two internal spaces are in fluid communication with each other via a communication chamber 15 positioned between the casing body 13 and the lid member 14 (at the lower ends of the square tube part 13*a* and the cylindrical port 13*b*). Thus, the internal space of the square tube part 13*a*, the communication chamber 15, and the internal space of the cylindrical part 13*b* form a gas passage having a substantial U-shape.

The casing 12 includes a tank port 17 and a purge port 18. The tank port 17 and purge port 18 extend upward from the first upper wall 13*d* and are in fluid communication with the internal space of the square tube part 13*a*. The tank port 17 is in fluid communication with a fuel tank (not shown), more specifically a gas space in the fuel tank. The purge port 18 is in fluid communication with an engine (not shown), more specifically an intake pipe of the engine downstream of a throttle valve. The casing 12 also includes an atmospheric port 19. The atmospheric port 19 extends upward from the second upper wall 13*e* and is in fluid communication with the internal space of the cylindrical part 13*b*. The atmospheric port 19 is open to the atmosphere.

The casing body 13 has a partition part 13*f* extending downward from the first upper wall 13*d* such that an upper portion of the internal space of the square tube part 13*a* is divided into right and left areas. In particular, the partition part 13*f* divides the upper portion of the internal space of the square tube part 13*a* into a tank port-side area and a purge port-side area. Each of an upper end of the tank port-side area and an upper end of the purge port-side area are provided with a filter 20.

A porous plate 21 is provided at a lower opening of the square tube part 13*a*. The porous plate 21 is made from a resin material or the like and has air permeability. A filter 22 is provided along an upper surface of the porous plate 21. A spring 23 is disposed between the porous plate 21 and the lid member 14. The spring 23 is a coil spring that biases the porous plate 21 in the upward direction. The square tube part 13*a* of the casing 12 and the filters 20, 22 form a first adsorption chamber 24.

As shown in FIG. 1, a first mixer 26 is disposed at the middle of the internal space of the cylindrical part 13*b* in the vertical direction, i.e., in the gas flowing direction. In addition, a second mixer 27 is disposed at a lower opening of the cylindrical part 13*b*. Detailed structures of the first mixer 26 and the second mixer 27 are described in more detail below.

A porous plate 28 is disposed above the second mixer 27 such that the second mixer 27 closes a lower end of the internal space of the cylindrical part 13*b*. The porous plate 28 is made from a resin material or the like and has air permeability. A spring 29 is disposed between the second mixer 27 and the lid member 14. The spring 29 is a coil spring that biases the second mixer 27 in the upward direction.

A filter 30 is disposed at an upper end of the internal space of the cylindrical part 13*b*. In addition, a filter 31 is disposed along an upper surface of the first mixer 26, a filter 32 is disposed along a lower surface of the first mixer 26, and a filter 33 is disposed along an upper surface of the porous plate 28. The cylindrical part 13*b* of the casing 12 and the filters 32, 33 form a second adsorption chamber 34 below the first mixer 26. In the gas flow direction from the atmospheric port 19 through the inside of the casing 12 to the purge port 18, the second adsorption chamber 34, the communication chamber 15, and the first adsorption chamber 24 are continuously arranged such that the communication chamber 15 is located between the second adsorption chamber 34 and the first adsorption chamber 24. Similarly, the cylindrical part 13*b* and the filters 30, 31 form a third adsorption chamber 35 above the first mixer 26. In addition, the cylindrical part 13*b* and the filters 31, 32 form an agitation chamber 36 that houses the first mixer 26 therein. The agitation chamber 36 provides fluid communication between the second adsorption chamber 34 and the third adsorption chamber 35. In the gas flow direction from the atmospheric port 19 through the inside of the casing 12 to the purge port 18, the third adsorption chamber 35, the agitation chamber 36, and the second adsorption chamber 34 are arranged continuously such that the agitation chamber 36 is located between the third adsorption chamber 35 and the second adsorption chamber 34. In this embodiment, each of the filters 20, 22, 30, 31, 32, 33 is made of resin-made non-woven fabric, foamed urethane or the like.

The first adsorption chamber 24, the second adsorption chamber 34, and the third adsorption chamber 35 are filled with an adsorbent 37 configured to adsorb and desorb the fuel vapor. More specifically, in the first adsorption chamber 24, the internal space between the filter 20 disposed at the upper end of the square tube part 13*a* and the filter 22 disposed at the lower end of the square tube part 13*a* is filled with the adsorbent 37. In the second adsorption chamber 34, the internal space between the filter 32 disposed below the first mixer 26 and the filter 33 disposed above the porous plate 28 is filled with the adsorbent 37. In the third adsorption chamber 35, the internal space between the filter 30 disposed at the upper end of the cylindrical part 13*b* and the filter 31 disposed above the first mixer 26 is filled with the adsorbent 37. In contrast, the communication chamber 15 and the agitation chamber 36 are not filled with the adsorbent 37. In this embodiment, the adsorbent 37 is granular activated carbon. The granular activated carbon may be crushed activated carbon, extruded activated carbon that is shaped from a mixture of activated carbon powder and binder, or the like.

The structure of the first mixer 26 will now be described. In this embodiment, the first mixer 26 is made from a resin material or the like. As shown in FIG. 1, the first mixer 26 is disposed in the agitation chamber 36.

Figure 2:
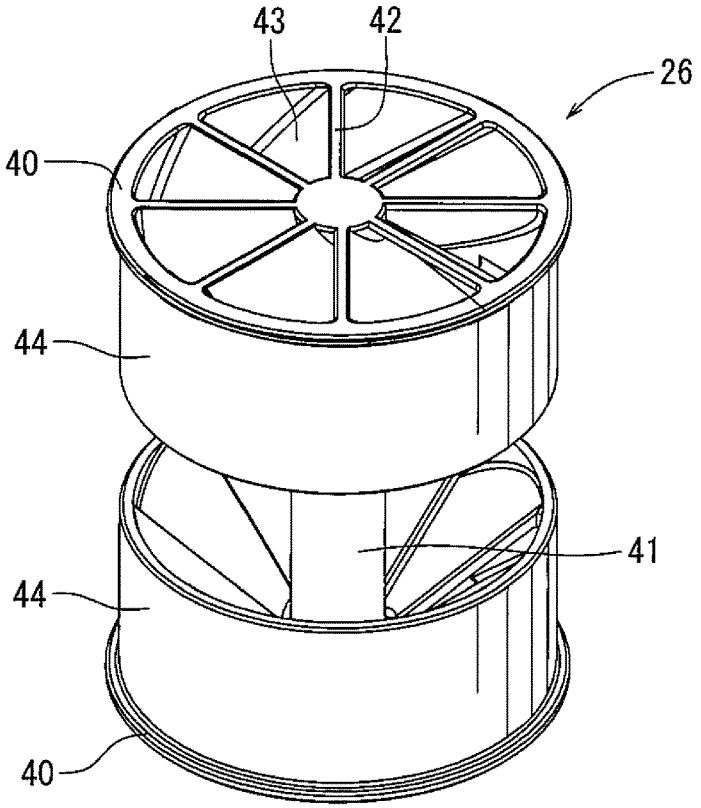
FIG. 2 is a perspective view of the first mixer of FIG. 1.
Figure 3:
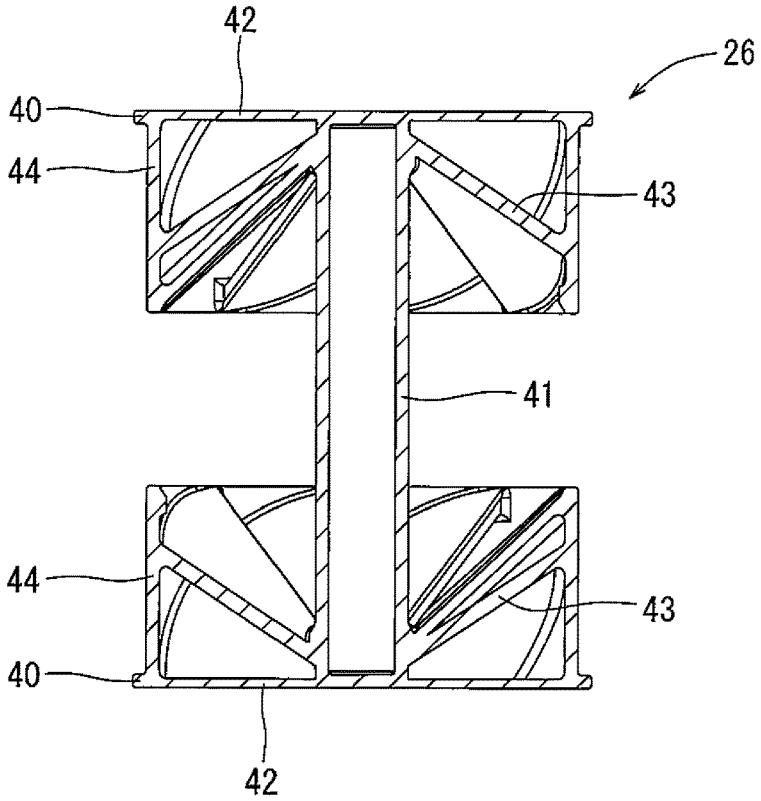
FIG. 3 is a cross-sectional view of the first mixer of FIG. 2.

As shown in FIGS. 2 and 3, the first mixer 26 includes a pair of upper and lower fitting parts 40, a shaft part 41, a plurality of connection parts 42, a plurality of agitation blades 43, and a pair of outer circumferential walls 44. The upper half of the first mixer 26 is the same as the lower half thereof, and thus, the upper half of the first mixer 26 will be described, and the lower half will not be described in the interest of conciseness.

As shown in FIG. 2, the fitting part 40 has an annular ring shape. The shaft part 41 extends in the vertical direction. Eight connection parts 42 extend radially outward from an upper end of the shaft part 41 to an internal circumference of the upper fitting part 40, thereby fixing the fitting part 40 to the shaft part 41. One agitation blade 43 extends obliquely downward from each connection part 42. The outer circumferential wall 44 has a hollow cylindrical shape extending downward from the fitting part 40 such that the outer circumferential wall 44 extends about the agitation blades 43. Accordingly, the agitation blade 43 may also be referred to as the "spiral flow forming part".

Figure 4:
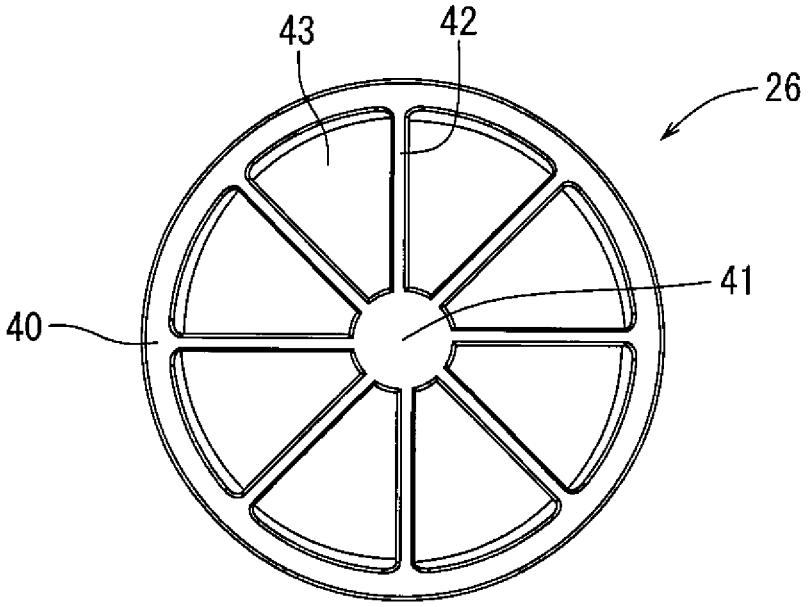
FIG. 4 is a plan view of the first mixer of FIG. 2.

As shown in FIG. 4, the connection parts 42 are uniformly circumferentially spaced. In addition, the agitation blades 43 are shaped and positioned such that there is no gap between the blades 43 within the fitting part 40 in the top plan view. More specifically, an inner circumferential end or edge of each agitation blade 43 extends obliquely along the shaft part 41, and an outer circumferential end or edge of each agitation blade 43 extends obliquely along an inner circumference of the outer circumferential wall 44. A leading edge of each agitation blade 43 circumferentially overlaps with the next agitation blade 43 in the vertical direction. Due to this configuration, when gas flows toward the agitation blades 43 from above, the agitation blades 43 guide the gas spirally around the shaft part 41. Here, in the plan view of the first mixer 26, the rotational direction of the downward gas flow guided by the upper agitation blades 43 is opposite to the rotational direction of the upward gas flow guided by the lower agitation blades 43. More specifically, in the plan view, the upper agitation blades 43 guide the gas flowing downward in the counterclockwise direction, and the lower agitation blades 43 guide the gas flowing upward in the clockwise direction.

As shown in FIG. 1, the fitting parts 40 of the first mixer 26 are fitted into the cylindrical part 13*b*. The fitting parts 40, end surfaces of the shaft part 41 and connection parts 42 support the filters 31, 32 such that the upper agitation blades 43 are adjacent to the third adsorption chamber 35 and the lower agitation blades 43 are adjacent to the second adsorption chamber 34. That is, in the gas flow direction from the atmospheric port 19 through the inside of the casing 12 to the purge port 18, the upper agitation blades 43 are disposed at the upstream end of the agitation chamber 36 and the lower agitation blades 43 are disposed at the downstream end of the agitation chamber 36.

Figure 5:
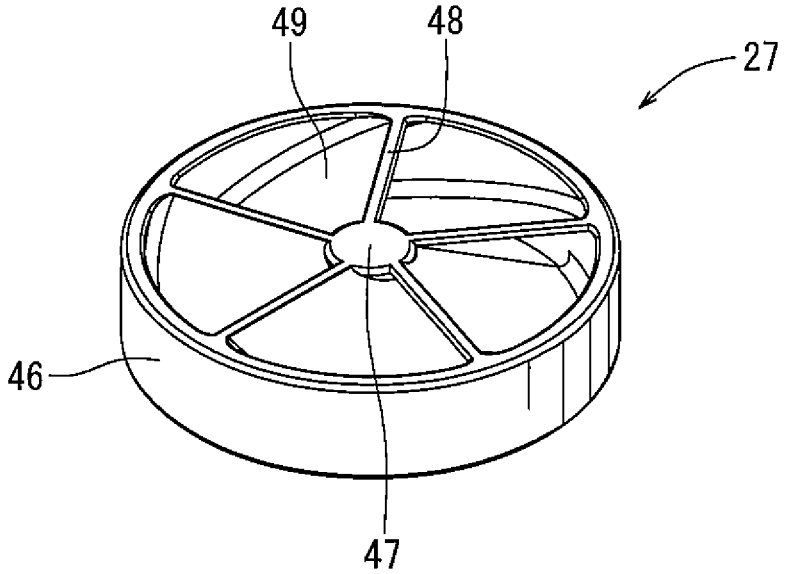
FIG. 5 is a perspective view of the second mixer of FIG. 1.

Next, the second mixer 27 will be described. In this embodiment, the second mixer 27 is made from a resin material. As shown in FIG. 5, the second mixer 27 includes an outer circumferential wall 46, a shaft part 47, five connection parts 48, and five agitation blades 49. The outer circumferential wall 46 has a hollow cylindrical shape and the shaft part 47 extends in the vertical direction. The connection parts 48 extend radially outward from an upper end of the shaft part 47 to an inner circumference of the outer circumferential wall 46. One agitation blade 49 extends obliquely downward from each connection part 48. As shown in FIG. 1, the outer circumferential wall 46 is shape to be fitted in the cylindrical part 13*b* below the porous plate 28.

The detailed structure of the agitation blades 49 will be described. The agitation blades 49 are uniformly circumferentially spaced. The agitation blades 49 are shaped and positioned such that there is no gap between the blades 49 within the outer circumferential wall 46 in the top plan view. More specifically, an inner circumferential end or edge of each agitation blade 49 extends obliquely downward along the shaft part 47 and an outer circumferential end or edge of each agitation blade 49 extends obliquely downward along an inner circumference of the outer circumferential wall 46. A leading edge of each agitation blade 49 circumferentially overlaps with the next agitation blade 49 in the vertical direction. Due to this configuration, the agitation blades 49 guide gas spirally around the shaft part 47 when the gas flows toward the agitation blades 49 from above. Accordingly, each of the agitation blades 49 may be referred to as a spiral flow forming part.

Referring again to FIG. 1, the function of the fuel vapor processing apparatus 10 will be described. In a state where the engine (not shown) of the vehicle is stopped or the like, the fuel vapor-containing gas composed of the fuel vapor and air is introduced into the first adsorption chamber 24 from a fuel tank (not shown) via the tank port 17. Thus, most of the fuel vapor contained in the fuel vapor-containing gas is adsorbed on the adsorbent 37 in the first adsorption chamber 24. Then, the fuel vapor-containing gas containing the remaining fuel vapor that is not adsorbed on the adsorbent 37 in the first adsorption chamber 24 is introduced into the second adsorption chamber 34 via the communication chamber 15 and is at least partially adsorbed on the adsorbent 37 in the second adsorption chamber 34.

Then, the fuel vapor-containing gas containing the remaining fuel vapor that is not adsorbed on the adsorbent 37 in the second adsorption chamber 34 is introduced into the agitation chamber 36. When the fuel vapor-containing gas flows into the agitation chamber 36, the fuel vapor-containing gas is spirally flowed around the shaft part 41 by the lower agitation blades 43 of the first mixer 26, i.e., the agitation blades 43 disposed on the second adsorption chamber 34 side, so as to be stirred in the agitation chamber 36. As a result, the density of the fuel vapor and the temperature of the fuel vapor-containing gas are homogenized in the agitation chamber 36. Then, the homogenized fuel vapor-containing gas is introduced into the third adsorption chamber 35. The remaining fuel vapor that is contained in the fuel vapor-containing gas is adsorbed on the adsorbent 37 in the third adsorption chamber 35. Then, the air is released into the atmosphere via the atmospheric port 19.

When the conditions for the purge operation are met during running of the engine, the intake negative pressure in the engine acts on the interior of the casing 12 via the purge port 18. In this state, the air is introduced into the third adsorption chamber 35 from the atmosphere via the atmospheric port 19. The air is also referred to as purge air. The purge air desorbs the fuel vapor from the adsorbent 37 in the third adsorption chamber 35, and flows into the agitation chamber 36. In the agitation chamber 36, the purge air is guided spirally and stirred by the upper agitation blades 43 of the first mixer 26, i.e., the agitation blades 43 disposed on the third adsorption chamber 35 side. That is, during flowing through the agitation chamber 36, the purge air is stirred by the first mixer 26 in the agitation chamber 36 so as to homogenize both the density of the fuel vapor contained in the purge air and the temperature of the purge air.

The homogenized purge air is introduced into the second adsorption chamber 34, thereby desorbing the fuel vapor from the adsorbent 37 in the second adsorption chamber 34. Then, the purge air flows into the communication chamber 15. The purge air is guided spirally around the shaft part 47 by the agitation blades 49 of the second mixer 27 in the communication chamber 15. That is, when the purge air flows through the communication chamber 15, the purge air is stirred by the second mixer 27 in the communication chamber 15 so as to homogenize both the density of the fuel vapor contained in the purge air and the temperature of the purge air.

The purge air homogenized in the communication chamber 15 is introduced into the first adsorption chamber 24, thereby desorbing the fuel vapor from the adsorbent 37 in the first adsorption chamber 24. Then, the purge air containing the fuel vapor is introduced into the engine via the purge port 18 so as to be burned in the engine. In this disclosure, when the agitation chamber 36 corresponds to "agitation chamber", the third adsorption chamber 35 corresponds to "atmospheric port-side adsorption chamber", and the second adsorption chamber 34 corresponds to "purge port-side adsorption chamber". Alternatively, when the communication chamber 15 corresponds to "agitation chamber", the second adsorption chamber 34 corresponds to "atmospheric port-side adsorption chamber", and the first adsorption chamber 24 corresponds to "purge port-side adsorption chamber".

In accordance with this embodiment, when the purge air flows into the agitation chamber 36, the purge air is guided and stirred by the agitation blades 43 of the first mixer 26 that is disposed in the agitation chamber 36. Thus, even if the fuel vapor is unevenly distributed between the central portion and the outer peripheral portion in the third adsorption chamber 35 such that the temperature of the purge air flowing into the agitation chamber 36 is unevenly distributed between the central portion and the outer peripheral portion in the third adsorption chamber 35, the purge air can be homogenized in the agitation chamber 36. As a result, the low-temperature purge air can be prevented from flowing into the central portion of the second adsorption chamber 34. That is, the purge air is homogenized in the agitation chamber 36 and then the homogenized purge air is introduced into the second adsorption chamber 34 so as to increase the desorption efficiency of the fuel vapor in the second adsorption chamber 34. In addition, when the purge air is guided spirally by the agitation blades 43, the purge air flows radially outward. Thus, it prevents the large amount of purge air from flowing into the central portion of the second adsorption chamber 34. Accordingly, differences in the flow amount of the purge air between the central portion and the outer peripheral portion of the second adsorption chamber 34 can be decreased so as to increase the desorption efficiency of the fuel vapor from the adsorbent 37 in the second adsorption chamber 34.

Similarly, when the purge air flows into the communication chamber 15, the purge air is spirally guided and stirred by the agitation blades 49 of the second mixer 27 that is disposed in the communication chamber 15. Thus, the purge air is homogenized in the communication chamber 15 to prevent the low-temperature purge air from flowing into the first adsorption chamber 24. Accordingly, the homogenized purge air is introduced into the first adsorption chamber 24 so as to increase the desorption efficiency of the fuel vapor from the adsorbent 37 in the first adsorption chamber 24.

Further, the agitation blades 43 of the first mixer 26 and the agitation blades 49 of the second mixer 27 are shaped to spirally guide the purge air. Due to this configuration, the time required for flowing through the agitation chamber 36 and the communication chamber 15 for the purge air is longer than the conventional device. When the purge air flows into the agitation chamber 36, the temperature of the purge air is lower than the outside air temperature due to vaporization heat generated by desorption of the fuel vapor. Thus, heat is transmitted from the outside air to the purge air in the agitation chamber 36 via the casing 12, so that the temperature of the purge air rises. Accordingly, the time in which the purge air stays in the agitation chamber 36 is longer, the temperature of the purge air is higher. As a result, the desorption efficiency of the fuel vapor in the second adsorption chamber 34 is improved. Similarly, when the purge air flows into the communication chamber 15, the temperature of the purge air increases in the communication chamber 15 due to heat of the outside air. Thus, the time in which the purge air stay in the communication chamber 15 is longer, the temperature of the purge air is higher. As a result, the desorption efficiency of the fuel vapor in the first adsorption chamber 24 is also improved.

In the flow direction of gas from the atmospheric port 19 to the purge port 18, the agitation blades 43 of the first mixer 26 are disposed at the upstream end of the agitation chamber 36. Thus, the distance in which the purge air flows spirally in the agitation chamber 36 is long so as to enhance homogenization of the purge air.

The agitation blades 43 are shaped to have no gap within the fitting part 40 in the top plan view. Due to this configuration, the purge air cannot flow linearly through the agitation chamber 36 so as to ensure efficient mixing of the purge air in the agitation chamber 36. Further, the first mixer 26 includes the outer circumferential wall 44 around the agitation blades 43. When the purge air is guided by the agitation blades 43, the outer circumferential wall 44 maintains the guided purge air radially therein. Thus, the spiral flow of the purge air can be enhanced. Accordingly, the purge air can be uniformly stirred. And, the period in which the purge air stay in the agitation chamber 36 can be lengthened. Similarly, the agitation blades 49 and the outer circumferential wall 46 of the second mixer 27 have the same effects in the communication chamber 15.

The upper end surface of the first mixer 26 is composed of the fitting part 40, the upper end of the shaft part 41, and the connection parts 42 that extend radially between the fitting part 40 and the shaft part 41. Thus, the opening area in the upper end surface of the first mixer 26 is larger than the conventional device, i.e., a plate having a plurality of holes that guide the purge air nonlinearly. Accordingly, pressure loss during the purge operation can be reduced. Similarly, the second mixer 27 has the same effects in the communication chamber 15.

The first mixer 26 includes the agitation blades 43 on the lower side, i.e., on the second adsorption chamber 34 side. Thus, when the fuel vapor-containing gas flows into the agitation chamber 36 from the second adsorption chamber 34 during the adsorption operation in which the fuel vapor is adsorbed on the adsorbent 37, the fuel vapor-containing gas is spirally guided by the lower agitation blades 43 of the first mixer 26. As a result, the density of the fuel vapor contained in the fuel vapor-containing gas and the temperature of the fuel vapor-containing gas are homogenized in the agitation chamber 36. Then, the fuel vapor-containing gas is introduced into the third adsorption chamber 35. Accordingly, differences in the amount adsorption between the central portion and the outer peripheral portion of the third adsorption chamber 35 are reduced. And, the high-temperature fuel vapor-containing gas is prevented from flowing into the third adsorption chamber 35. Thus, the adsorption efficiency of the fuel vapor in the third adsorption chamber 35 is improved.

Next, other embodiments will be described with reference to the accompanying drawings. In general, the additional embodiments described below are substantially the same as the first embodiment described above with some changes to the shape of the first mixer. Thus, while the changes will be described, same configurations will not be described in the interest of conciseness.

Figure 6:
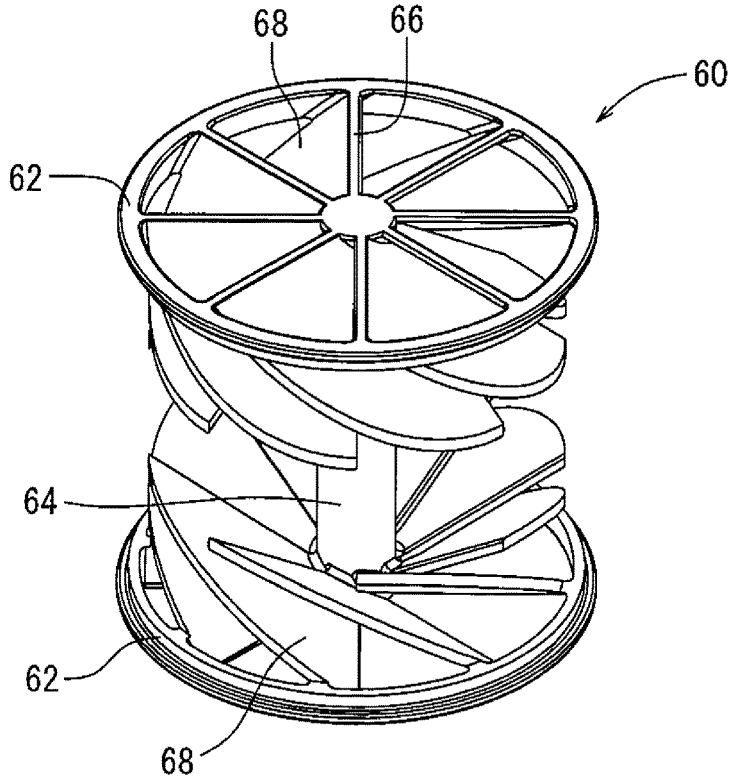
FIG. 6 is a perspective view of an embodiment of a first mixer in accordance with principles described herein.

As shown in FIG. 6, a second embodiment of a first mixer 60 includes a fitting part 62, a shaft part 64, connection parts 66, and agitation blades 68. The fitting part 62, the shaft part 64, the connection parts 66, and the agitation blades 68 of the first mixer 60 have the same configurations as the fitting part 40, the shaft part 41, the connection parts 42, and the agitation blades 43, respectively, as previously described. That is, as shown in FIGS. 2 and 6, the first mixer 60 differs from the first mixer 26 in that the first mixer 60 includes no outer wall (e.g., outer circumferential wall 44).

Figure 7:
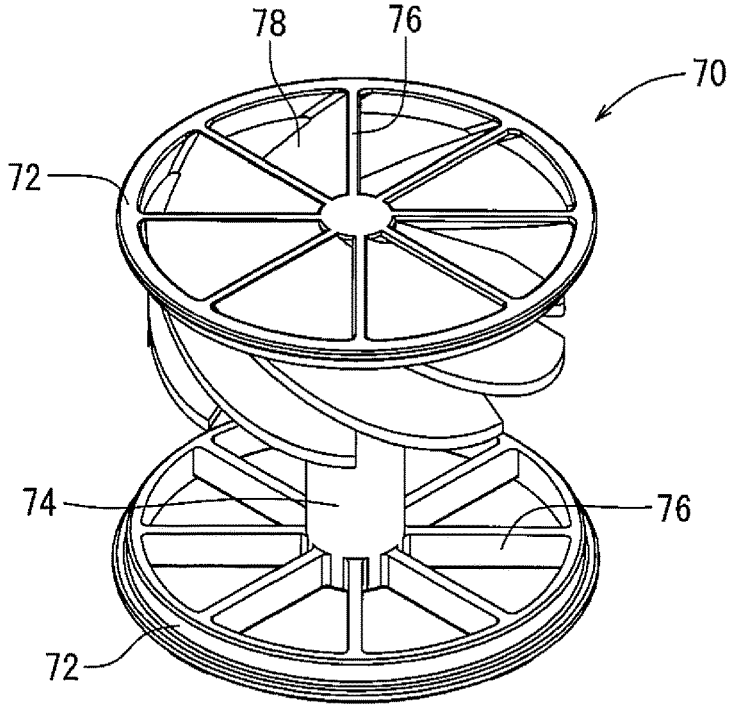
FIG. 7 is a perspective view of an embodiment of a first mixer in accordance with principles described herein.

As shown in FIG. 7, an upper half of a third embodiment of a first mixer 70 includes a fitting part 72, a shaft part 74, connection parts 76, and agitation blades 78. The fitting part 72, the shaft part 74, the connection parts 76, and the agitation blades 78 of the upper half of the first mixer 70 have the same configurations as the fitting part 62, the shaft part 64, the connection parts 66, and the agitation blades 68, respectively, of the upper half of the first mixer 60 previously described. On the other hand, a lower half of the first mixer 70 includes the fitting part 72, the shaft part 74, and the connection parts 76 only. That is, as shown in FIGS. 6 and 7, the first mixer 70 differs from the first mixer 60 in that the lower half of the first mixer 70 does not include any agitation blade (e.g., agitation blades 43). The first mixer 70 is disposed in the agitation chamber 36 such that the upper half including the agitation blades 78 is adjacent to the third adsorption chamber 35. That is, the upper half of the first mixer 70 is disposed in the agitation chamber 36 at the upstream end in the gas flow direction from the atmospheric port 19 to the purge port 18.

Figure 8:
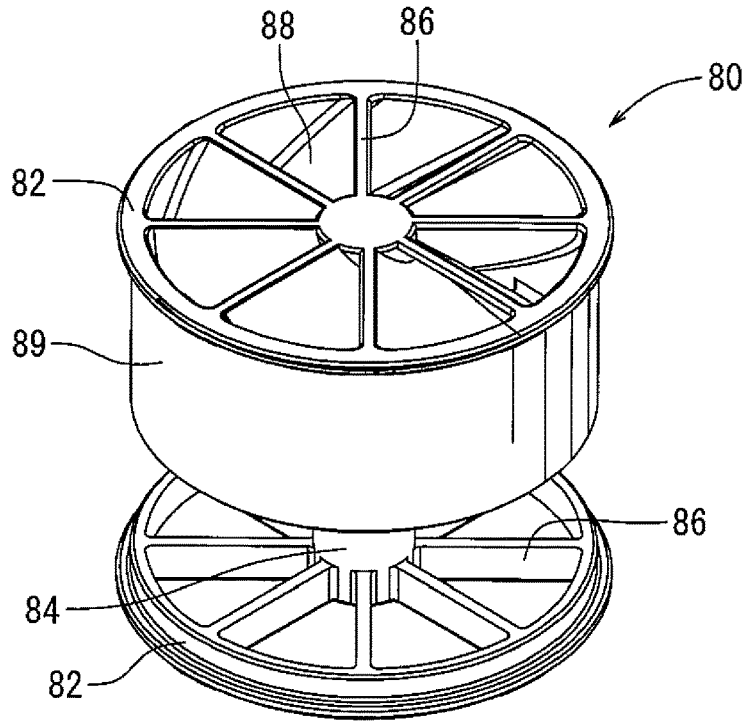
FIG. 8 is a perspective view of an embodiment of a first mixer in accordance with principles described herein.

As shown in FIG. 8, a fourth embodiment of a first mixer 80 includes fitting parts 82, a shaft part 84, connection parts 86, agitation blades 88, and an outer circumferential wall 89. The fitting parts 82, the shaft part 84, the connection parts 86, and the agitation blades 88 have the same configurations as the fitting parts 72, the shaft part 74, the connection parts 76, and the agitation blades 78, respectively, of the first mixer 70 previously described. The outer circumferential wall 89 has a hollow cylindrical shape extending downward from the upper fitting part 82 and is disposed around the agitation blades 88. That is, the first mixer 80 differs from the first mixer 70 in that the first mixer 80 includes the outer circumferential wall 89.

Figure 9:
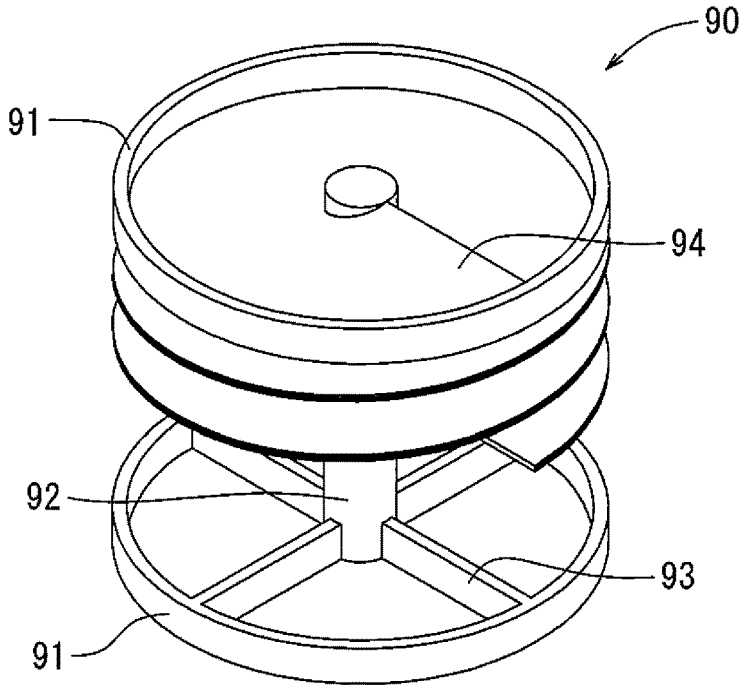
FIG. 9 is a perspective view of an embodiment of a first mixer in accordance with principles described herein.

As shown in FIG. 9, a fifth embodiment of a first mixer 90 includes a pair of upper and lower fitting parts 91, a shaft part 92, a plurality of connection parts 93, and a slope 94. Each of the fitting parts 91 has an annular ring shape. The shaft part 92 has a cylindrical shape extending in the vertical direction. The connection parts 93 extend radially outward from the lower end of the shaft part 92 to the lower fitting part 91 and are uniformly circumferentially spaced, thereby connecting the shaft part 92 to the lower fitting part 91. The slope 94 spirally extends around an upper half of the shaft part 92. More specifically, an inner circumferential end or edge of the slope 94 extends obliquely downward along an outer circumference of the shaft part 92, and an outer circumferential end or edge of the slope 94 extends along an inner circumference of the upper fitting part 91 and projected cylindrical surface extending between the fitting parts 91. The first mixer 90 is disposed in the agitation chamber 36 such that the upper end surface of the first mixer 90 is adjacent to the third adsorption chamber 35.

Figure 10:
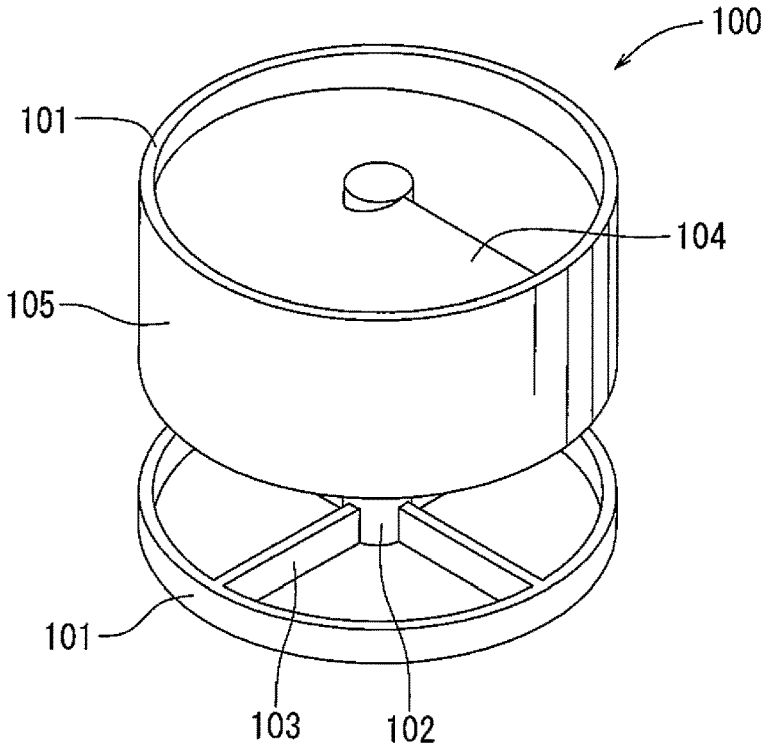
FIG. 10 is a perspective view of an embodiment of a first mixer in accordance with principles described herein.

As shown in FIG. 10, a sixth embodiment of a first mixer 100 includes fitting parts 101, a shaft part 102, connection parts 103, a slope 104, and an outer circumferential wall 105. The fitting parts 101, the shaft part 102, the connection parts 103, and the slope 104 have the same configurations with the fitting parts 91, the shaft part 92, the connection parts 93, and the slope 94, respectively, of the first mixer 90 previously described. The outer circumferential wall 105 has a hollow cylindrical shape extending downward from the upper fitting part 101 and is disposed around the slope 104. The outer circumferential edge of the slope 104 extends along an inner circumference of the outer circumferential wall 105. That is, the first mixer 100 differs from the first mixer 90 in that the first mixer 100 includes the outer circumferential wall 105.

Figure 11:
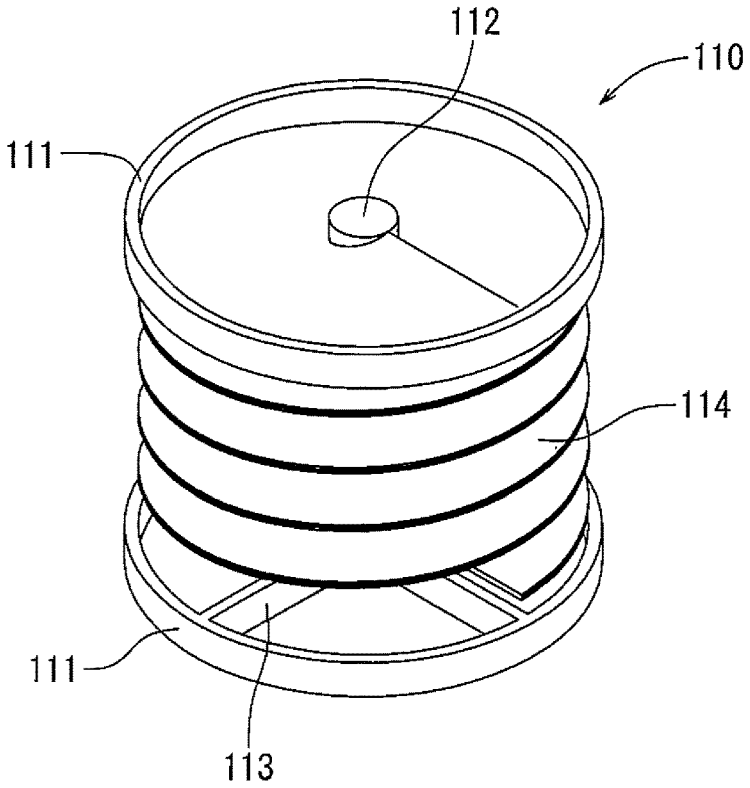
FIG. 11 is a perspective view of an embodiment of a first mixer in accordance with principles described herein.

As shown in FIG. 11, a seventh embodiment of a first mixer 110 includes fitting parts 111, a shaft part 112, connection parts 113, and a slope 114. The fitting parts 111, the shaft part 112, and the connection parts 113 have the same configurations as the fitting parts 91, the shaft part 92, and the connection parts 93, respectively, of the first mixer 90 previously described. The slope 114 has a spiral shape extending from the upper end of the shaft part 112 to the vicinity of the connection parts 113. An inner circumferential edge of the slope 114 extends obliquely downward along the shaft part 112. An outer circumferential edge of the slope 114 extends along an inner circumference of the upper fitting part 111 and a projected cylindrical surface extending between the fitting parts 111. That is, the first mixer 110 differs from the first mixer 90 in that the slope 114 of the first mixer 110 extends vertically over almost the whole length of the shaft part 112.

Figure 12:
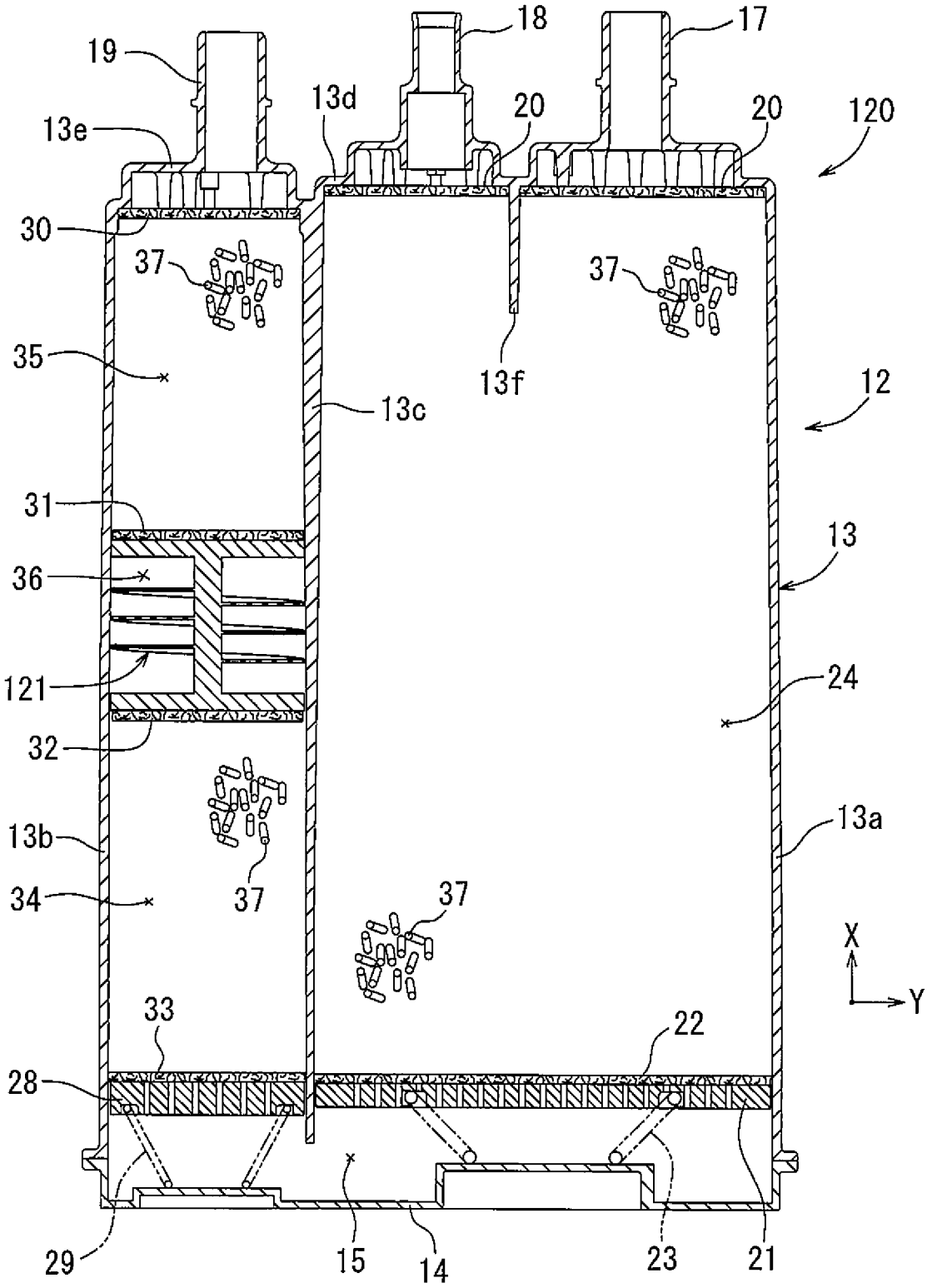
FIG. 12 is a cross-sectional view of an embodiment of a fuel vapor processing apparatus including a first mixer in accordance with principles described herein.

As shown in FIG. 12, an embodiment of a fuel vapor processing apparatus 120 has the same configuration as the fuel vapor processing apparatus 10 previously described except that the fuel vapor processing apparatus 120 includes a first mixer 121 instead of the first mixer 26 and does not include the second mixer 27. Thus, while such changes will be described, same configurations are followed by the same reference signs and will not be described in the interest of conciseness.

Figure 13:
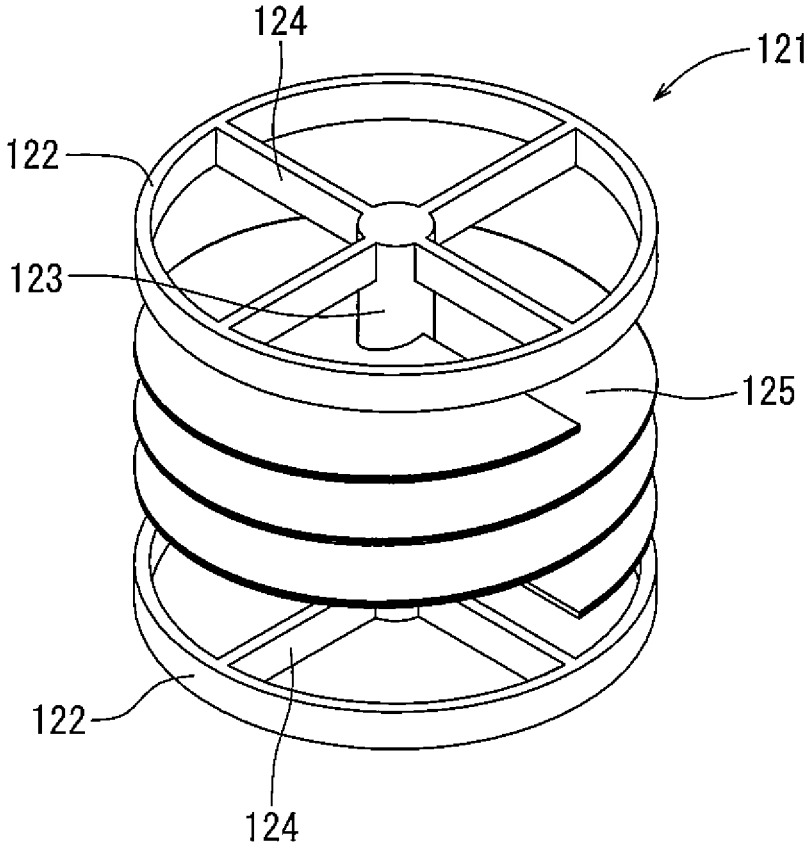
FIG. 13 is a perspective view of the first mixer of FIG. 12.

As shown in FIG. 12, in this embodiment, the fuel vapor processing apparatus 120 includes the first mixer 121 at the approximate center of the cylindrical part **13*b* in the vertical direction. As shown in FIG. 13, the first mixer 121 includes a pair of fitting parts 122, a shaft part 123, connection parts 124, and a slope 125. Each of the fitting parts 122 has an annular ring shape. The shaft part 123 has a cylindrical shape extending in the vertical direction. The connection parts 124 extend radially outward from both an upper end and a lower end of the shaft part 123 to the fitting parts 122 and are uniformly circumferentially spaced so as to connect the shaft part 123 to the fitting parts 122. The slope 125 has a spiral shape and is disposed at a central portion of the shaft part 123 in the vertical direction. More specifically, an inner circumferential end or edge of the slope 125 extends along outer surface of the shaft part 123, and an outer circumferential end or edge of the slope 125 extends along a projected cylindrical surface extending between the upper and lower fitting parts 122. The slope 125 extends spirally three times about the shaft part 123 between height positions that equally divide the shaft part 123** in three in the vertical direction.

In this embodiment, when the purge air flows into the agitation chamber 36, the purge air is guided and stirred by the slope 125 of the first mixer 121 in the agitation chamber 36. Thus, even if the desorption amount of the fuel vapor is unevenly distributed between the central portion and the outer peripheral portion in the third adsorption chamber 35 such that the temperature of the purge air is unevenly distributed between the central portion and the outer peripheral portion in the third adsorption chamber 35, the purge air is homogenized in the agitation chamber 36. As a result, the low-temperature purge air can be prevented from flowing into the central portion of the second adsorption chamber 34. That is, the purge air is homogenized in the agitation chamber 36, and then the homogenized purge air is introduced into the second adsorption chamber 34 so as to increase the desorption efficiency of the fuel vapor in the second adsorption chamber 34. In addition, when the purge air is guided spirally by the slope 125, the purge air flows radially outward. Thus, it is able to prevent a large amount of the purge air from flowing into the central portion of the second adsorption chamber 34. Accordingly, differences in the amount of flow of the purge air between the central portion and the outer peripheral portion in the second adsorption chamber 34 is decreased so as to increase the desorption efficiency of the fuel vapor from the adsorbent 37 in the second adsorption chamber 34.

Further, during the adsorption operation of the fuel vapor on the adsorbent 37, when the fuel vapor-containing gas flows into the agitation chamber 36 from the second adsorption chamber 34, the fuel vapor-containing gas is guided and stirred by the slope 125 of the first mixer 121 in the agitation chamber 36. Thus, even if the adsorption amount of the fuel vapor is unevenly distributed between the central portion and the outer peripheral portion in the second adsorption chamber 34 such that the temperature of the fuel vapor-containing gas is unevenly distributed between the central portion and the outer peripheral portion in the second adsorption chamber 34, the fuel vapor-containing gas is homogenized in the agitation chamber 36. Accordingly, the high-temperature fuel vapor-containing gas is prevented from flowing into the central portion of the third adsorption chamber 35. As a result, the adsorption efficiency of the fuel vapor in the third adsorption chamber 35 is improved.

The present disclosure is not limited to the above-described embodiments and can be modified variously. For example, the fuel vapor processing apparatus may include the atmospheric port-side adsorption chamber, the agitation chamber, and the purge port-side adsorption chamber arranged continuously. Thus, the fuel vapor processing apparatus may include two adsorption chambers and one agitation chamber only. In general, a gas passage including the atmospheric port-side adsorption chamber, the agitation chamber, and the purge port-side adsorption chamber may have any shape. The purge port of the fuel vapor processing apparatus may also serve as the tank port. The spiral flow forming part may have any shape capable of guiding gas spirally other than blade shape and slope shape. The shapes of the agitation blade and the slope, such as inclination, and the number of the agitation blades can be changed as necessary. The agitation chamber and the mixer may have any cross-sectional shape that is perpendicular to the gas flow direction other than circular shape. The spiral flow forming part is required to be disposed in the agitation chamber and may be disposed at a portion of the agitation chamber in the gas flow direction, such as at an upstream or downstream end only. The present teaching can be applied to fuel vapor processing apparatuses for various devices, such as ship or industrial machine.

Main aspect of the present teachings are described below. In one aspect, a fuel vapor processing apparatus includes a casing, an adsorbent, and a mixer. The casing includes an atmospheric port and a purge port. The casing forms an atmospheric port-side adsorption chamber, an agitation chamber, and a purge port-side adsorption chamber therein. The atmospheric port-side adsorption chamber, the agitation chamber, and the purge port-side adsorption chamber are continuously arranged in a gas flow direction from the atmospheric port through the inside of the casing to the purge port. The adsorbent is filled in the atmospheric port-side adsorption chamber and the purge port-side adsorption chamber. The adsorbent is capable of adsorbing and desorbing fuel vapor. The mixer is disposed in the agitation chamber and includes a spiral flow forming part. The spiral flow forming part is configured to spirally guide gas flowing through the agitation chamber.

In accordance with this aspect, while the gas flows through the agitation chamber, the gas is spirally guided and stirred by the spiral flow forming part of the mixer in the agitation chamber. Thus, during the purge operation, the purge air can be easily mixed in the agitation chamber so as to efficiently homogenize the purge air. The desorption efficiency of the fuel vapor in the purge port-side adsorption chamber by introducing the homogenized purge air into the purge port-side adsorption chamber. Similarly, during the adsorption operation, the fuel vapor-containing gas can be easily mixed in the agitation chamber so as to efficiently homogenize the fuel vapor-containing gas. The adsorption efficiency of the fuel vapor in the atmospheric port-side adsorption chamber can be increased by introducing the homogenized fuel vapor-containing gas into the atmospheric port-side adsorption chamber.

In another aspect, the spiral flow forming part may be disposed at least one of an upstream end and a downstream end of the agitation chamber in the gas flow direction.

The purge air flows from the upstream side to the downstream side in the gas flow direction. Thus, when the spiral flow forming part is disposed at the upstream end of the agitation chamber, the distance in which the purge air spirally flows in the agitation chamber is relatively long. As a result, homogenization of the purge air can be enhanced. On the other hand, the fuel vapor-containing gas flows in the opposite direction to the gas flow direction, i.e., from the downstream side to the upstream side, in the gas flow direction. Thus, when the spiral flow forming part is disposed at the downstream end of the agitation chamber, the distance in which the fuel vapor-containing gas spirally flows in the agitation chamber is relatively long. As a result, homogenization of the fuel vapor-containing gas can be enhanced.

In another aspect, the spiral flow forming part may be composed of a plurality blades that are uniformly circumferentially spaced. Due to this configuration, the gas flowing into the agitation chamber can be guided efficiently.

In another aspect, the spiral flow forming part may have a spiral slope shape. Due to this configuration, the gas flowing into the agitation chamber can be guided efficiently.

In the other aspect, the mixer may include an outer circumferential wall extending around the spiral flow forming part such that the outer circumferential wall is disposed radially outside the spiral flow forming part. The outer circumferential wall keeps the gas spirally flowing within the outer circumferential wall in the radial direction so as to enhance homogenization of the gas.

What is claimed is:

1. A fuel vapor processing apparatus, comprising:

a casing including an atmospheric port and a purge port, wherein the casing forms an atmospheric port-side adsorption chamber, an agitation chamber, and a purge port-side adsorption chamber therein, wherein the atmospheric port-side adsorption chamber, the agitation chamber, and the purge port-side adsorption chamber are continuously arranged in a gas flow direction from the atmospheric port through the casing to the purge port;

an adsorbent filling the atmospheric port-side adsorption chamber and the purge port-side adsorption chamber, wherein the adsorbent is configured to adsorb and desorb fuel vapor; and a mixer disposed in the agitation chamber and including first and second spiral flow forming parts, wherein the first and second spiral flow forming parts include a plurality of circumferentially-spaced blades configured to spirally guide gas flowing through the agitation chamber, and wherein the first spiral flow forming part is disposed at an upstream end of the agitation chamber in the gas flow direction and the second spiral flow forming part is disposed at a downstream end of the agitation chamber in the gas flow direction.

2. The fuel vapor processing apparatus according to claim 1, wherein the mixer includes an outer circumferential wall extending about at least one of the first and second spiral flow forming parts.

3. A fuel vapor processing apparatus, comprising:

a casing including an atmospheric port and a purge port, wherein the casing forms an atmospheric port-side adsorption chamber, an agitation chamber, and a purge port-side adsorption chamber therein, wherein the atmospheric port-side adsorption chamber, the agitation chamber, and the purge port-side adsorption chamber are continuously arranged in a gas flow direction from the atmospheric port through the casing to the purge port;

an adsorbent filling the atmospheric port-side adsorption chamber and the purge port-side adsorption chamber, wherein the adsorbent is configured to adsorb and desorb fuel vapor; and a mixer disposed in the agitation chamber and including a spiral flow forming part and a shaft part, wherein the spiral flow forming part includes a plurality of circumferentially-spaced blades or a spiral slope shape configured to spirally guide gas flowing through the agitation chamber, wherein the spiral flow forming part is disposed at an upstream end or a downstream end of the agitation chamber in the gas flow direction, and wherein the shaft part extends from the upstream end to the downstream end of the agitation chamber.

4. The fuel vapor processing apparatus according to claim 3, wherein the mixer includes an outer circumferential wall extending about the spiral flow forming part.

* * * * *